US011092294B2

(12) United States Patent
MacLeish et al.

(10) Patent No.: US 11,092,294 B2
(45) **Date of Patent: *Aug. 17, 2021**

(54) LIGHTING MODULE ASSEMBLY AND METHOD OF USE

(71) Applicant: R&B Wagner, Inc., Butler, WI (US)

(72) Inventors: Michael S. MacLeish, Cedarburg, WI (US); Joshua Vizanko, Saukville, WI (US)

(73) Assignee: R&B Wagner, Inc., Butler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/660,221

(22) Filed: Oct. 22, 2019

(65) Prior Publication Data

US 2020/0088365 A1 Mar. 19, 2020

Related U.S. Application Data

(63) Continuation of application No. 15/808,507, filed on Nov. 9, 2017, now Pat. No. 10,612,734.

(51) Int. Cl.
*F21S 4/28* (2016.01)
*F21S 4/20* (2016.01)
(Continued)

(52) U.S. Cl.
CPC ..... *F21S 4/20* (2016.01); *E04F 11/1802* (2013.01); *E04F 11/1836* (2013.01); *F21S 4/28* (2016.01);
(Continued)

(58) Field of Classification Search
None
See application file for complete search history.

(56) References Cited

U.S. PATENT DOCUMENTS 8,485,684 B2 7/2013 Lou et al.
9,206,953 B2 12/2015 Roos
(Continued)

FOREIGN PATENT DOCUMENTS

CN 105240741 1/2016
DE 102013112303 11/2013
(Continued)

OTHER PUBLICATIONS

Search report submitted from EP Application No. 18876342.9 dated Jan. 28, 2021.
(Continued)

*Primary Examiner* — Elmito Breval
(74) *Attorney, Agent, or Firm* — James Joyce; Godfrey & Kahn, S.C.

(57) ABSTRACT

A lighting module assembly, including a module base and module cover housing a light source, and having latches sized and spaced so as to mate with the channels of the module base, each latch having a latch tab at a distal end of the latch. A locking unit connects the module cover and the module base together. The locking unit is formed of a springy material and includes two locking bodies and a ramped tang extending from the bottom of the locking body, and a pair of latch members, one mounted on each side of the ramped tang. The module cover includes a reflector portion for receiving light from the light source. The assembly may be provided with a tool with a plurality of prongs, connected by a handle and which, when inserted, engage the ramped tang and move the latches, to release the lighting module from the support base.

10 Claims, 15 Drawing Sheets

(51) Int. Cl.

| | |
|---|---|
| ***F21V 21/04*** | (2006.01) |
| ***F21V 29/70*** | (2015.01) |
| ***E04F 11/18*** | (2006.01) |
| ***F21V 5/08*** | (2006.01) |
| ***F21V 7/04*** | (2006.01) |
| ***F21V 15/01*** | (2006.01) |
| ***F21V 17/18*** | (2006.01) |
| ***F21V 23/00*** | (2015.01) |
| *F21S 8/02* | (2006.01) |
| *F21Y 115/10* | (2016.01) |
| *F21V 5/04* | (2006.01) |
| *F21W 111/08* | (2006.01) |

(52) U.S. Cl.

CPC ..... *F21V 5/08* (2013.01); *F21V 7/041* (2013.01); *F21V 15/01* (2013.01); *F21V 17/18* (2013.01); *F21V 21/04* (2013.01); *F21V 23/003* (2013.01); *F21V 29/70* (2015.01); *E04F 2011/1872* (2013.01); *F21S 8/02* (2013.01); *F21V 5/04* (2013.01); *F21V 23/001* (2013.01); *F21W 2111/08* (2013.01); *F21Y 2115/10* (2016.08)

(56) References Cited

U.S. PATENT DOCUMENTS

| | | | | |
|---|---|---|---|---|
| 10,024,502 | B1 * | 7/2018 | Purdy | F21K 9/272 |
| 10,197,252 | B2 | 2/2019 | Veloskey et al. | |
| 10,612,734 | B2 * | 4/2020 | MacLeish | F21V 17/18 |
| 2013/0201665 | A1 | 8/2013 | Roos | |
| 2014/0268649 | A1 | 9/2014 | Mandy et al. | |
| 2019/0093864 | A1 | 3/2019 | Huang et al. | |
| 2019/0113212 | A1 | 4/2019 | Dorman et al. | |
| 2019/0242552 | A1 | 8/2019 | Liu | |

FOREIGN PATENT DOCUMENTS

| | | |
|---|---|---|
| DE | 202014101297 | 6/2014 |
| EP | 1724516 | 11/2006 |
| WO | 2011082457 | 7/2011 |

OTHER PUBLICATIONS

Search report submitted from PCT/US2018/060083 dated Jan. 22, 2019.

* cited by examiner

LIGHTING MODULE ASSEMBLY AND METHOD OF USE

CROSS-REFERENCE TO RELATED APPLICATIONS

This application is a continuation of U.S. patent application Ser. No. 15/808,507, filed on Nov. 9, 2017, which is incorporated herein by reference in its entirety for all purposes.

FIELD OF THE INVENTION

The present invention relates generally to the field of lighting, and specifically to light module assemblies for use in railings or other tubular fixtures.

BACKGROUND

Lighting for use in railings, so as to provide light to pathways and footfalls, is known. Historically incandescent lighting had been used. Once more efficient light sources became available generally, such sources were adapted to be used for lighting in railings.

More efficient light sources included fluorescent and halogen-based lighting. Each of those two types carried their own disadvantages, as fluorescent bulbs presented disposal issues related to the inclusion of mercury and other heavy metals, whereas, halogen-based lighting had the capability to create more heat than the incandescent bulbs they replaced.

One of the newest sources of lighting, the LED lamp, combines the advantages of low power usage, low temperature, and long life. Even with these advantages, however, LED lamps as used in railings can suffer from difficulties, including difficulty in installation and difficulty in access for maintenance. One such LED lighting assembly for installation into a handrail is described in U.S. Pat. No. 9,206,953. This product requires the insertion of a retaining element into an opening in the railing, and then inserting a light body into the retaining element. Upon removal, however, under certain conditions the retaining element remains inside the handrail and may be difficult to remove, which could interfere with the installation of a different lighting fixture. Even the two-piece nature of the installation itself may make installation more difficult, with the requirement of handling of multiple parts.

This invention relates to improvements to the apparatus described above and to solutions to some of the problems raised or not solved thereby.

SUMMARY OF THE INVENTION

The invention provides a lighting module assembly for mounting in a hollow member. The assembly includes a module base having an outer shape and at least two channels formed in sides thereof. A module cover houses a light source and has an outer shape that, at least in one dimension, substantially matches the outer shape of the module base. The module cover also has latches sized and spaced so as to substantially mate with the channels of the module base, each latch having a latch tab at a distal end of the latch. A locking unit connects the module cover and the module base together. The locking unit is formed of a springy material and has two locking bodies opposing each other and connected together by a spanner. Each locking body includes two shoulder sections, one extending outward in a direction from the locking body different than the other shoulder section, two arm sections, one extending downwardly from each shoulder section, a locking body aperture formed centrally through the locking body and capable of engaging with a respective latch tab, a ramped tang extending from the bottom of the locking body away from the spanner, and also toward the opposite locking unit, and a pair of latch members, one mounted on each side of the ramped tang, and each having a wall with a latch bottom portion extending from the bottom of the locking body away from the spanner. The spanner has a resilient shape, which during abutment with a top inner surface portion of a hollow member, imparts a resilient downward force on the latch bottom portions in abutment with an inner wall surface of the hollow member to provide securement within the hollow member. The apparatus further includes a pair of slots in each body channel for receiving the arm sections of the locking bodies, and a pair of notches in a cap of the module base for receiving the arm sections of the locking bodies. The arm sections of the locking bodies extend into the slots and the notches to substantially align the slots and the notches and to secure the cap of the module base. The module cover includes a cover wall having a cover wall bottom and a cover wall top, and the cover wall includes a pair of cover channels that extend at least partially along the height of the cover wall. The module cover includes a reflector portion for receiving light from the light source. The reflector portion is conical and directs light symmetrically downward along a central vertical axis that extends through the module cover and module base. Alternatively, the reflector portion may be angled to direct light non-symmetrically away from a central vertical axis that extends through the module cover and module base.

The invention further provides a lighting module assembly for mounting in a hollow member that includes a locking unit, formed of a support base having a plurality of bracing arms extending therefrom, an outer wall surface, and an opposing an inner wall surface. The support base further includes a first vertical end wall and a second vertical end wall spaced apart by a first gap. A plurality of latches extend from the support base, wherein one or more latches includes at least one of a latch tab or a latch slot. A lighting module includes a light source and circuit board to deliver power to the light source, and further includes an outer wall having at least one of a wall tab or wall slot sized and shaped to matingly engage with the latch tab or latch slot. The bracing arms and support base are formed in a generally cylindrical shape, and the outer wall surface and the inner wall surface are curved to provide a C-shape in cross-section. The support base includes a bottom ledge that extends inward from the outer wall surface to join a bottom side wall that extends downward and parallel to the outer wall surface. The lighting module includes a ring having a larger outer dimension than the outer wall, the ring having a top ring ledge surface where the ring intersects the outer wall, which top ring ledge surface contacts the bottom ledge of the support base when the lighting module is inserted into the support base. The lighting module may include a plurality of apertures for receiving therein a plurality of prongs, wherein the prongs are connected by a handle and when inserted, engage and move the latches to disengage the wall tab or wall slot from the latch tab or a latch slot, to release the lighting module from the support base.

Other embodiments, aspects, features, objectives, and advantages will be understood and appreciated upon a full reading of the detailed description and the claims that follow.

DESCRIPTION OF THE DRAWINGS

Embodiments of the lighting module assembly are disclosed with reference to the accompanying drawings and are for illustrative purposes only. The lighting module assembly is not limited in its application to the details of construction or the arrangement of the components illustrated in the drawings. The lighting module assembly is capable of other embodiments or of being practiced or carried out in other various ways. In the drawings.

DETAILED DESCRIPTION

Any reference to "substantially" in this description means "within conventional tolerances." For example, if two elements are described as "substantially matching," or that they "substantially mate," that means that the two elements match or mate within conventional tolerances.

Figure 1:
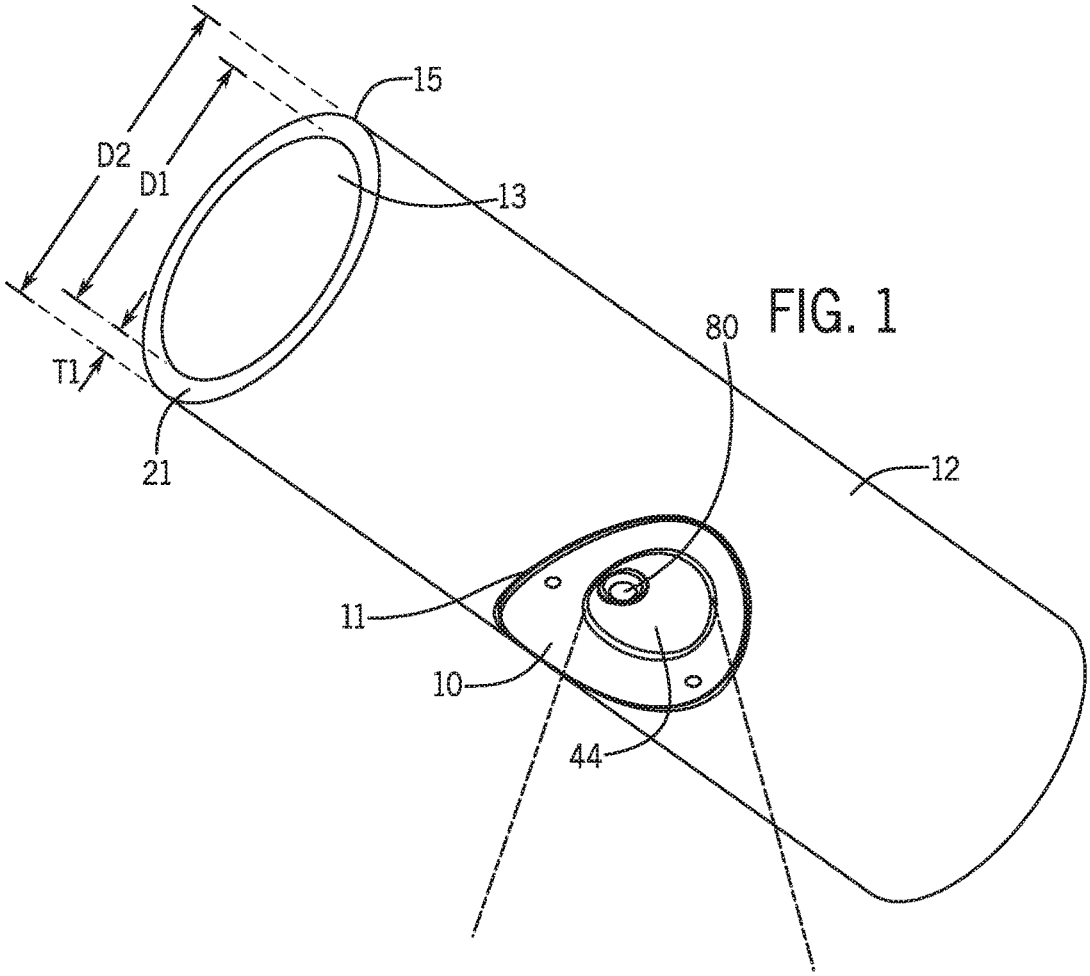
FIG. 1 is a bottom perspective view of an exemplary lighting module assembly installed in an exemplary tubular member, constructed according to one embodiment of the invention.

Referring to FIG. 1, an exemplary lighting module assembly 10 is shown installed in an exemplary hollow or tubular member 12. The tubular member 12 includes a member wall 21, having a wall thickness T1, formed by a member inner wall surface 13 having an inner dimension D1, and a member outer surface 15 having an outer dimension D2. The member 12 can be formed with a circular cross-section or a non-circular cross-section, including pipes, wall tubes, railings, etc., and can include any one of various types of configurations, shapes, and sizes, including open and closed members 12. For example, in at least some embodiments, the member 12 is circular in cross section, while in other embodiments the member 12 can be elliptical (e.g., oval), square, etc., in cross section. In at least some embodiments, the member 12 can be circular having about a 1.5-inch outside diameter D2 and a 0.120-inch wall thickness T1, or about a 1.66-inch outside diameter D2 and a 0.140-inch wall thickness T1, or about a 1.90-inch outside diameter D2 and a 0.145-inch wall thickness T1.

Figure 2A:
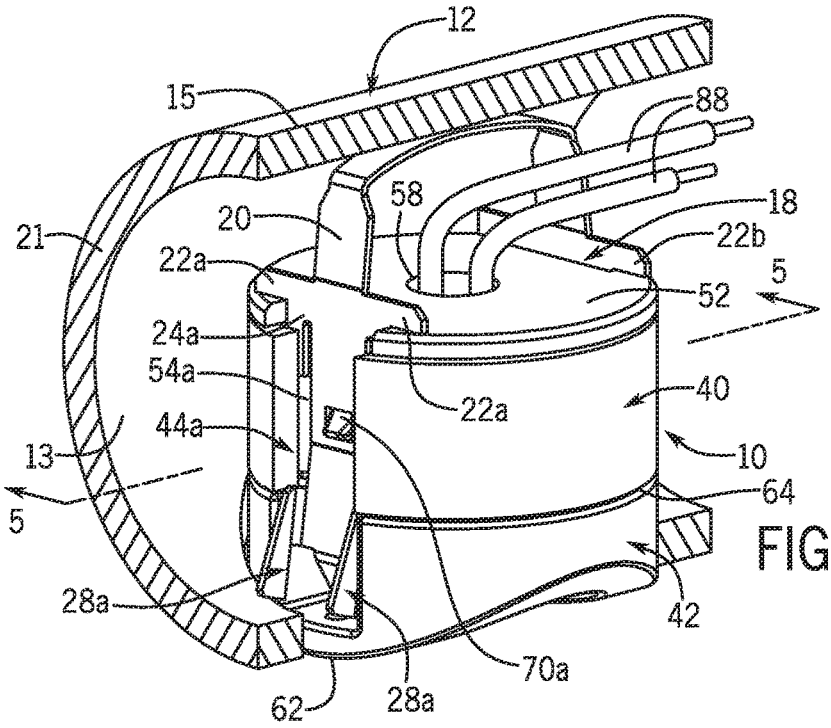
FIG. 2A is a top perspective view of the lighting module assembly shown in FIG. 1 with a portion of the tubular member of FIG. 1 cut away to better show the lighting module assembly.
Figure 2B:
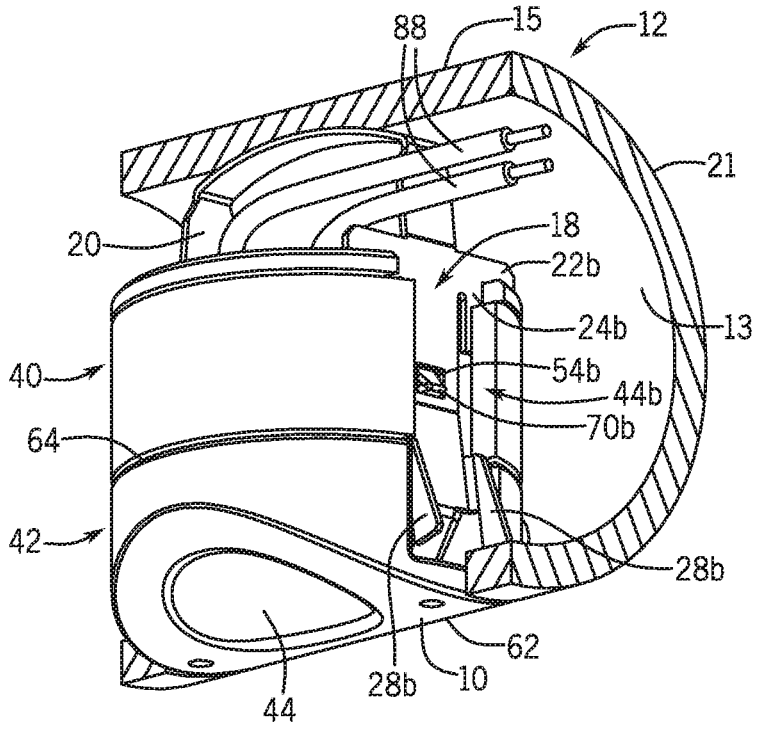
FIG. 2B is a bottom perspective view of the lighting module assembly shown in FIG. 1, with a portion of the tubular member of FIG. 1 cut away to better show the lighting module assembly.

Referring to FIGS. 2A and 2B, the tubular member 12 is illustrated in a cross-section cut-away view to expose the exemplary lighting module assembly 10 for purposes of description. As shown, the assembly 10 is sized and shaped to be received in, and at least partially or substantially enclosed by, the tubular member 12. In this manner, the majority of the assembly 10 can be concealed, including the wiring connections 88.

Figure 3:
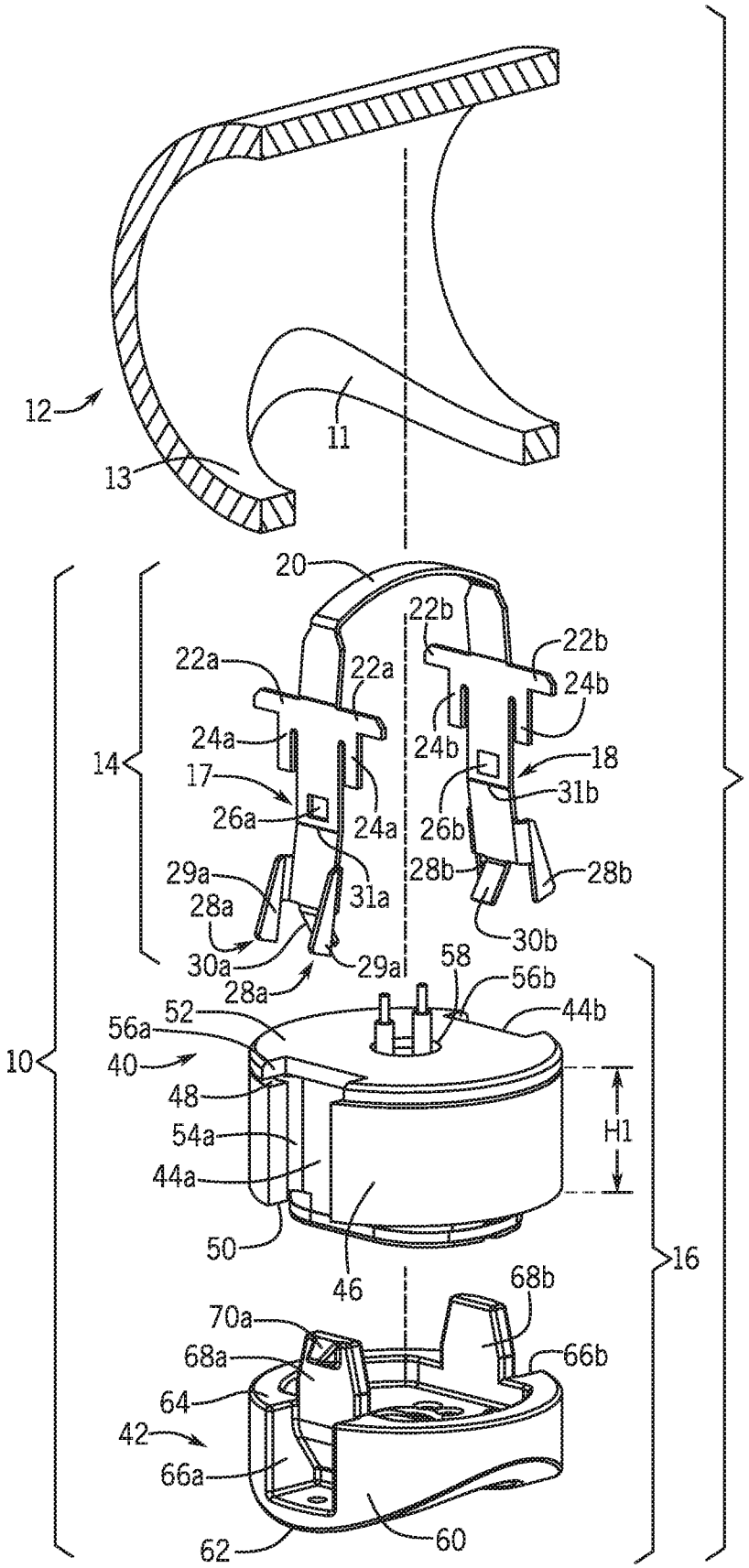
FIG. 3 is an exploded view of the lighting module assembly and tubular member shown in FIGS. 2A and 2B.
Figure 4:
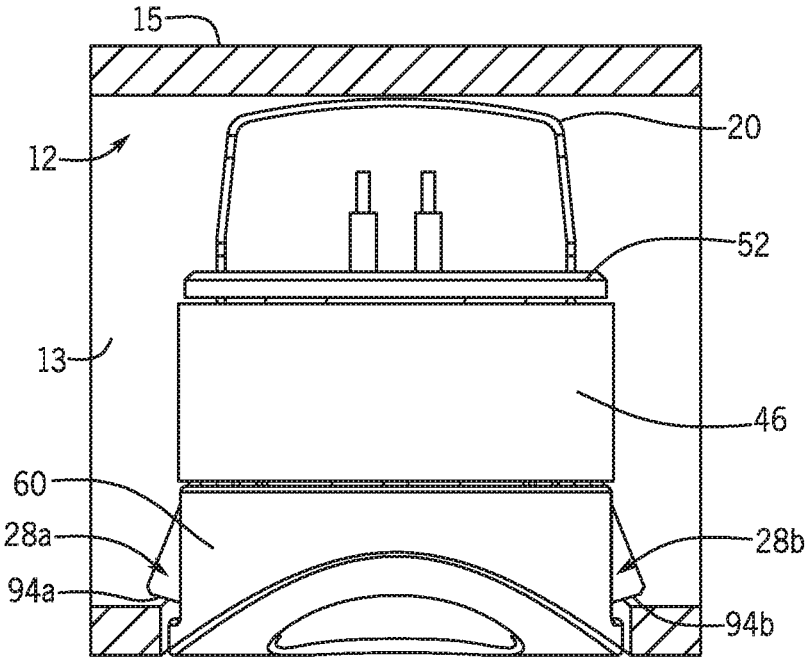
FIG. 4 is a side elevation view of the lighting module assembly shown in FIGS. 2A and 2B, with the tubular member partially cut away.

Referring to FIGS. 2A and 2B, and to FIG. 3 where the assembly 10 is shown in an exploded form, the assembly includes a locking unit 14 and a lighting module 16. The locking unit 14 is comprised of a first locking body 17 and a second locking body 18 connected together by a spanner 20. In at least some embodiments, the components of locking unit 14 are integrally formed from a single piece of material while, in other embodiments, one or more of the components can be separately formed and secured to the others, as will be described in further detail below. The locking unit 14 can be comprised of one or more of numerous types of resiliently flexible (e.g., springy) materials, such as spring steel, plastic, polymers, etc. In at least some embodiments, the material, shape, and size, of the locking unit 14 are selected to provide a tensioned (e.g., sprung) engagement with the lighting module 16, as described in further detail below.

As shown, spanner 20 forms an arc to provide a general expandable spring force to first locking body 17 and the second locking body 18, although in other embodiments, the spanner 20 can include various other shapes and sizes to secure the first locking body 17 and the second locking body 18. As shown, in at least some embodiments, the first locking body 17 and the second locking body 18 are symmetrical about the spanner 20. The first locking body 17 includes a pair of shoulders 22*a* projecting laterally outward from respective sides of the body. A pair of arms 24*a* extend downward from respective shoulders 22*a*. The first locking body 17 further includes a first locking body aperture 26*a*, and a pair of tapered latch members 28*a* each having a tapered side wall 29*a*. The first locking body 17 also includes a tang 30*a* that, in at least some embodiments, is bent or otherwise ramped, for engagement with a disengagement tool, as described below. Similarly, in at least some embodiments, the second locking body 18 includes a pair of shoulders 22*b* projecting laterally outward from respective sides of the body. A pair of arms 24*b* each extend downwardly from each of the respective shoulders 22*b*. The second locking body 18 further includes a second locking body aperture 26*b*, and a pair of spaced latch members 28*b*, each having a tapered side wall 29*b*. The second locking body 18 also includes a tang 30*b* that, in at least some embodiments, is bent or otherwise ramped, for engagement with a disengagement tool, as described below. The first locking body 17 further includes a bend point 31*a* (e.g., a bend line) situated between the first locking body aperture 26*a* and the latch members 28*a* such that, at rest, the latch member 28*a* is angled outwards, that is, away from second locking body 18, relative to the first locking body aperture 26*a*. Similarly, the second locking body 18 also includes a bend point 31*b* (e.g., a bend line) situated between the second locking body aperture 26*b* and the latch members 28*b* such that, at rest, the latch members 28*b* are angled outwards, that is, away from first locking body 17, relative to the second locking body aperture 26*b*.

Figure 5:
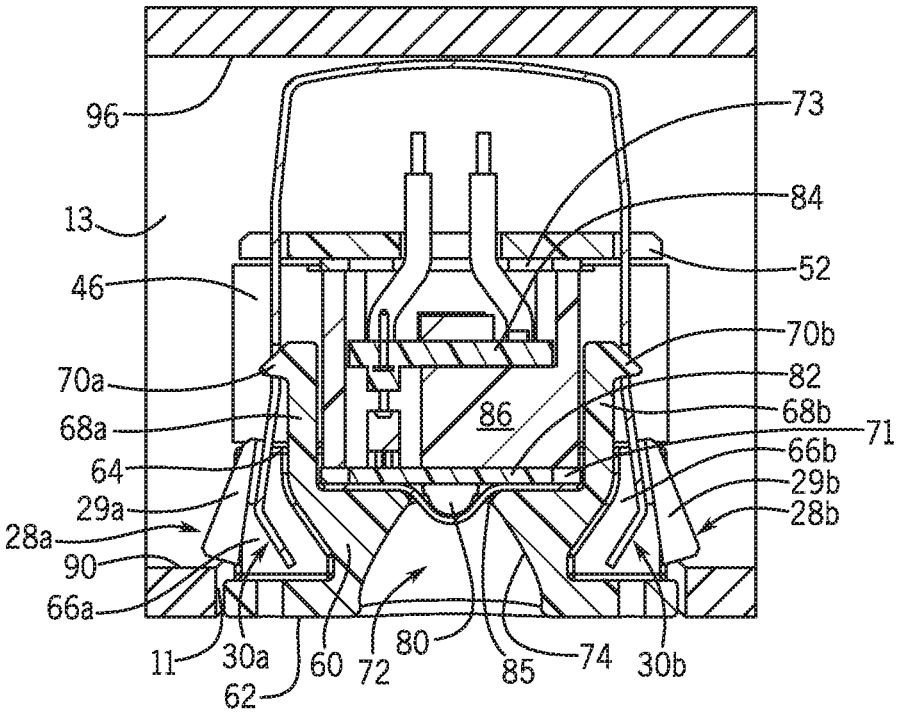
FIG. 5 is a cross sectional view of the tubular member and the lighting module assembly shown in FIG. 2A, taken along lines 5-5.

The lighting module 16 is comprised of a module base 40 and a module cover 42. As will be explained in more detail below, in some embodiments module cover 42 may also act as a reflector, so as to shape the light being projected outwardly by the lighting assembly. The module base 40 and module cover 42 may be formed integrally, provided in a single housing, or they can include separate housings that are secured together, either independently or through the use of the locking unit 14, as shown in FIGS. 3 and 5, for instance. The module base 40 includes an outer wall 46 having a wall top 48 and a wall bottom 50, with a height H1 extending therebetween, and a cap 52 securable to the top 48. In at least some embodiments, as shown in FIG. 3, the outer wall 46 includes a pair of body channels 44*a* and 44*b*, which extend along the height H1 of the module base 40 on opposing sides. The outer wall 46 further includes a pair of slots in each body channel 44*a* and 44*b*, slot 54*a* in body channel 44*a* and slots 54*b* in body channel 44*b*. The cap 52 can include a pair of notches 56*a* and 56*b* on opposing sides. Upon assembly, the respective body channels (44*a* and 44*b*), slots (54*a* and 54*b*) and notches 56*a* and 56*b* all substantially align. The cap 52 can also include a cap aperture 58 for providing the passage of wires or other connective elements to and from the module base 40.

Referring to FIGS. 2A-5, the module cover 42 includes a cover wall 60 having a cover wall bottom 62 and a cover wall top 64. As shown, in at least some embodiments, particularly when the a module cover 42 is not integral with the module base 40, the cover wall 60 includes a pair of cover channels 66*a* and 66*b* formed therein that extend at least partially along the height of the cover wall 60 and opening at the cover wall top 64. In addition, a pair of latches 68*a* and 68*b* extend upwards from the cover wall top 64, each latch terminating in a hook or latch tab 70*a* (and 70*b*). The module cover 42 further includes a reflector portion 72, which in some embodiments can include a conical-shaped surface 74, as well as a reflective material or coating thereon to reflect light outwards.

Referring to FIGS. 2A, 2B and 5, the assembly 10 is shown in an assembled form and installed in the member 12. FIG. 5 in particular illustrates a cross-sectional view of the assembly 10, wherein various internal components are visible. The module base 40 includes a light source 80, for example an LED. In at least some embodiments, the light source 80 is an LED connected to an LED circuit board 82. The light source 80 is positioned adjacent the wall bottom 50 so as to pass light into the reflector portion 72 of the module cover 42. The LED circuit board 82 is interconnected with an LED driver circuit board 84, which provides the driving power for the LED. The circuit boards 82, 84 can in at least some embodiments be in contact with a heat sink 86 that is secured to or integrally formed with the outer wall 46. Outer wall 46 thus can also have the functionality of a heat sink, so as to further dissipate heat generated within, to the outside of the lighting module assembly 10.

Power wires 88 supply power to the LED driver circuit board 84 and can pass out from the cover through the cover aperture 58 or other apertures. Although two circuit boards and an LED light source are shown and described, other light sources can be used, as is known in the art, as well as other circuit board configurations, as necessary to power the light source, including less or more circuit boards as needed or desired. Further, as shown in FIG. 5 by example, a lens 85 can be provided to protect the light source 80. In at least some embodiments, the lens 85 can be at least partially secured between the cover wall 60 and the LED circuit board 82.

Still referring to FIGS. 2A, 2B and 5, assembly of the assembly 10 includes positioning the module base 40 onto the module cover 42, such that the wall bottom 50 is adjacent to the cover wall top 64. In this position, the latches 68*a* and 68*b* are positioned in respective body channels 44*a* and 44*b* to form the lighting module 16. In embodiments where the module base 40 and the module cover 42 are integral, this step would be omitted. The locking unit 14 is then pushed onto the lighting module 16. As shown, installation of the locking unit 14 over the lighting module 16 provides various engagements to secure the module base 40 to the module cover 42 and the locking unit 14 to the lighting module 16. More particularly, as the locking unit 14 is being engaged with the lighting module 16, the first locking body 17 and second locking body 18 are slid into respective body channels 44*a* and 44*b* and cover channels 66*a* and 66*b* until the first locking body aperture 26*a* and second locking body aperture 26*b* engage respective latching tabs 70*a* and 70*b* of latches 68*a* and 68*b*. As shown best in FIGS. 2A and 2B, the arms 24*a* and 24*b* slide into respective slots 54*a* and 54*b* to positively engage the module base 40, and the shoulders 22*a* and 22*b* engage the top surface of the cap 52 to apply a downward force when the locking unit 14 is locked in place by the body apertures 26*a* and 26*b* engaging with the latching tabs 70*a* and 70*b* of respective latches 68*a* and 68*b*. In use, the arms 24*a*, 24*b* have at least three functions. First, they align the spanner 20 to the module base 40 and module cover 42 for assembly. Second, they laterally restrain the module base 40 and module cover 42 from moving once engaged. Third, they are "arms" instead of solid projecting tangs so that the arms 24*a*, 24*b* are long enough so as to reduce the spring forces, by moving the flex point of the effective spring formed by the arms upwards, thereby allowing the arms to flex more easily.

It is to be noted that the dimensions of various interfacing portions, such as the slots and arms, tabs and apertures, etc. can be varied to provide suitable interfaced fitment. As shown in FIG. 5 by example, a lens gasket 71 is provided between the lens 85 and the heat sink 86 to provide a waterproof or substantially waterproof seal. In at least some embodiments, the lens gasket 71 is comprised of a foam material, with adhesive on both sides that extends adjacent the perimeter of the heat sink. The lens gasket 71 can be formed of relatively soft or springy material so as to act as a spring to take up any loose tolerance in the parts, and thus improve the fit of the parts together, as well as to seal the interconnection between the module base 40 and the module cover 42. To further seal the module assembly 10, a cap gasket 73 may be provided atop the heat sink 86 to engage with the cap 52.

After the locking unit 14 is secured to the lighting module 16, the assembly 10 can be installed into the member 12. A member aperture 11 is formed in the member 12 that is sized and shaped to correspondingly receive the assembly therethrough, while allowing sufficient engagement with the member inner wall surface 13 for supporting the latch members 28*a* and 28*b* after insertion of the assembly 10. In the embodiments shown, the member aperture 11 is round, but the shape of the aperture is arbitrary, and could be oval, square, triangular, or any other suitable shape. The only limitation is that the outer cross sectional shape of the assembly 10 needs to substantially match that shape of the member aperture 11. As shown, the latch members 28*a* and 28*b* are tapered, such that when the latch members 28*a* and 28*b* are pressed against the member aperture 11 during insertion of the assembly 10 through the member aperture 11 into the member 12, they are progressively flexed inwardly (against their outward bias provided by their bend points 31*a* and 31*b*) into the respective cover channels 66*a* and 66*b* thereby allowing the assembly 10 to be inserted.

The tapered walls 29*a* and 29*b* each include respective latch bottom portions 94*a* and 94*b*. When the tapered walls 29*a* and 29*b* are inserted such that the latch bottom portions 94*a* and 94*b* pass the thickness T1 of the member wall 21, the latch bottom portions 94*a* and 94*b* move outward (again by means of the bias provided by their bend points 31*a* and 31*b*) to position at least a portion of the latch members 28*a* and 28*b* inside the member 12 such that at least in part, the latch bottom portions 94*a* and 94*b* engage the member inner wall surface 13 of the member 12. In this manner, the assembly 10 is secured inside the member 12. In at least some embodiments, to assist with securement and/or removal of the assembly 10, the spanner 20 can be sized and shaped to engage a top inner surface portion 96 of the member wall 21, which is situated opposite the member aperture 11. In this manner, a downward bias (spring tension) is provided by the spanner 20 to prevent the assembly 10 from moving any further into the member 12, as well as to provide a force to eject the assembly 10 during removal.

Figure 6A:
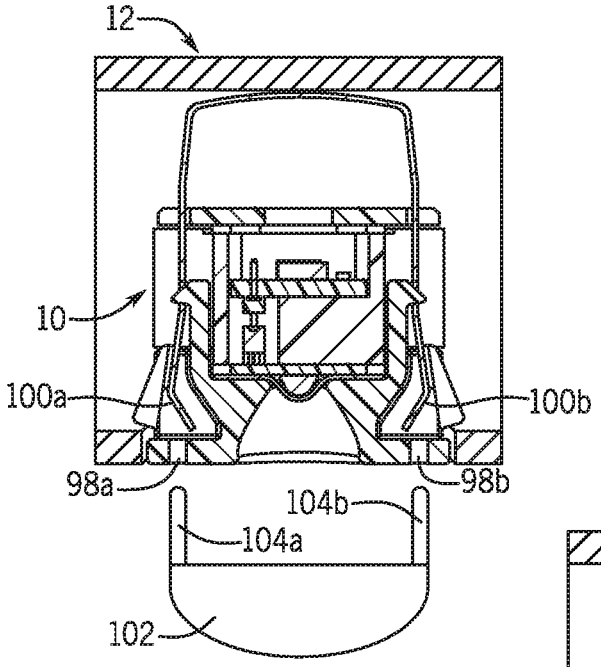
FIGS. 6A, 6B and 6C are cross sectional views of both the tubular member and the lighting module assembly as shown in FIG. 5, along with a disengagement tool, in different positions of engagement of the lighting module with the tubular member.
Figure 6B:
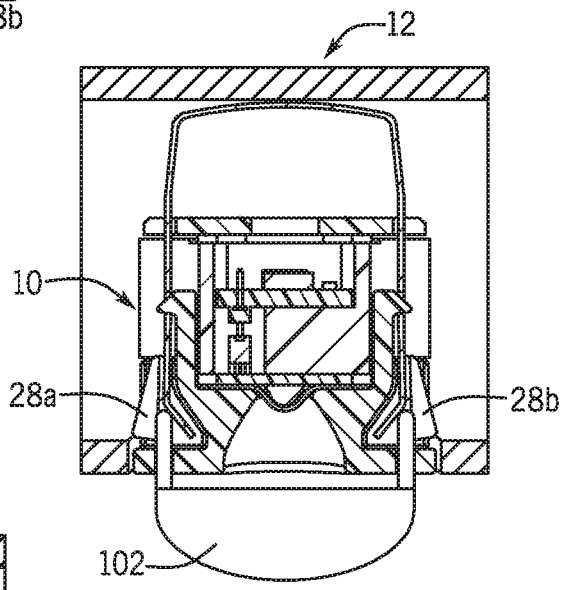
Figure 6C:
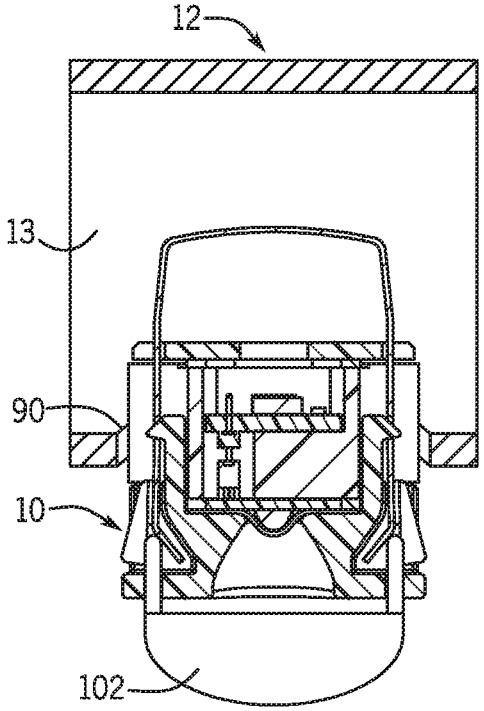
Figure 7:
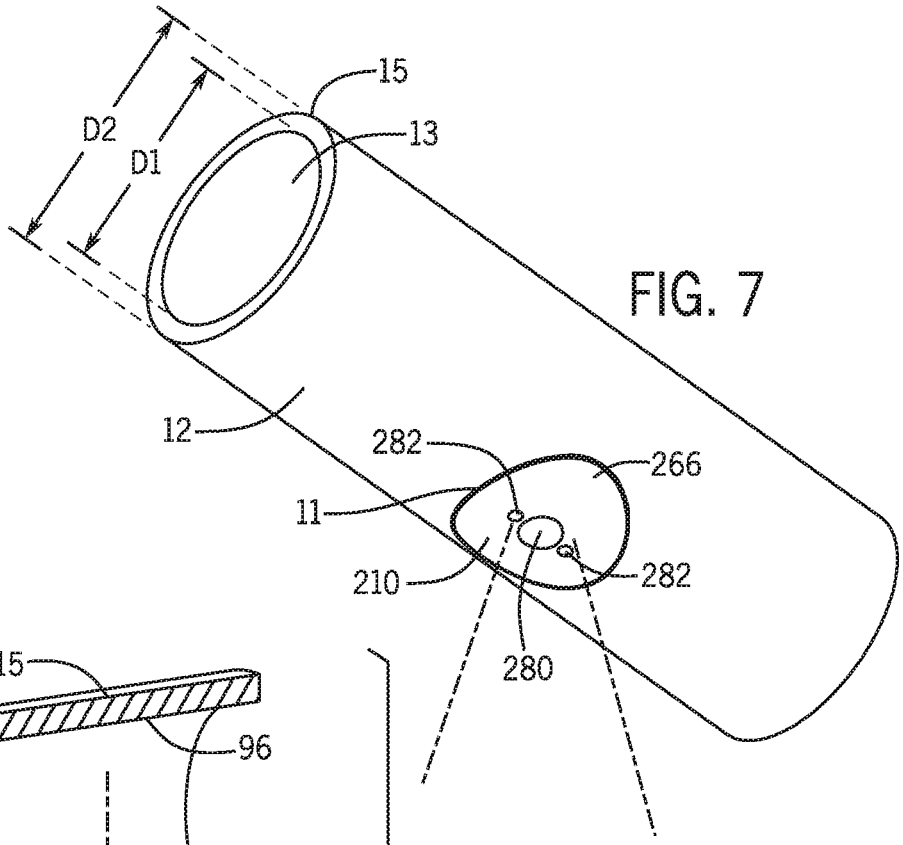
FIG. 7 is a bottom perspective view of an exemplary lighting module assembly installed in an exemplary tubular member, constructed according to another embodiment of the invention.

Referring now to FIGS. 6A-6C, various cross-section views are provided to illustrative an exemplary removal process for the assembly 10 from the member 12. As shown, the module cover 42 includes a plurality of cover apertures 98*a* and 98*b*, which are positioned to align with respective tangs 30*a* and 30*b*. More particularly, the tangs 30*a* and 30*b* are bent or angled inward such that each includes a ramped surface 100*a* and 100*b*. An insertion tool 102 may be provided, with tines or prongs 104*a* and 104*b*, sized, shaped and spaced apart to substantially contemporaneously pass through the cover apertures 98*a* and 98*b* respectively. The length of the tines or prongs 104*a* and 104*b* is determined so as to be sufficient to contact the ramped surfaces 100*a* and 100*b* of the tangs 30*a* and 30*b* (FIG. 6B) as will now be described. When the prongs 104*a* and 104*b* are inserted through the cover apertures 98*a* and 98*b*, the prongs 104*a* and 104*b* engage the ramped surfaces 100*a* and 100*b* of the tangs 30*a* and 30*b* (FIG. 6B), and the tips of the prongs move along the ramped surfaces. Thereby the latch members 28*a* and 28*b* are progressively moved inward, and latch bottom portions 94*a* and 94*b* are moved off of engagement with the member inner wall surface 13 sufficiently so as to allow the assembly 10 to be disengaged and removed from the member 12 (FIG. 6C). Various other removal configurations are contemplated, including the use of tool-less removal using finger actuators, etc.

Referring now to FIGS. 7-14, another exemplary lighting module assembly 210 is shown installed in the exemplary tubular member 12, constructed according to another embodiment of the invention. As shown in the exploded view of FIG. 8, the assembly 210 includes a locking unit 214 and a lighting module 216. The locking unit 214 includes a plurality of bracing arms 218 extending from a C-shaped support base 220, the locking unit 214 having an outer wall surface 222 opposite an inner wall surface 224. The support base 220 includes a first vertical end wall 204 and a second vertical end wall 206, which at rest are spaced apart by a gap G1 (see FIG. 9B). Opposite the support base 220, each bracing arm 218 includes an arm end 219 that is sized and shaped so as to, when installed inside member 12, generally contact the top inner surface portion 96 of the member wall 21. That is, this embodiment includes a plurality of arm ends 219, one at the end of each bracing arm 218, each arm end 219 contacting a respective one of a plurality of disconnected points on the interior surface of the hollow member 12. The bracing arms 218 and support base 220 are formed in a generally cylindrical shape, wherein the outer wall surface 222 and the inner wall surface 224 are curved to provide a broken circular shape (e.g., C-shape) in cross-section. In addition to the bracing arms 218, a first latch 226 and a second latch 228 extend from opposing sides of the support base 220, each latch having a latch hook or latch tab 270 protruding inward, at the distal end of the respective latch. The support base 220 includes a bottom ledge 250 that extends inward from the outer wall surface 222 to join a bottom side wall 252 that extends further down and parallel to the outer wall surface 222. Side wall 252 terminates in a bottom wall 253.

Figure 9A:
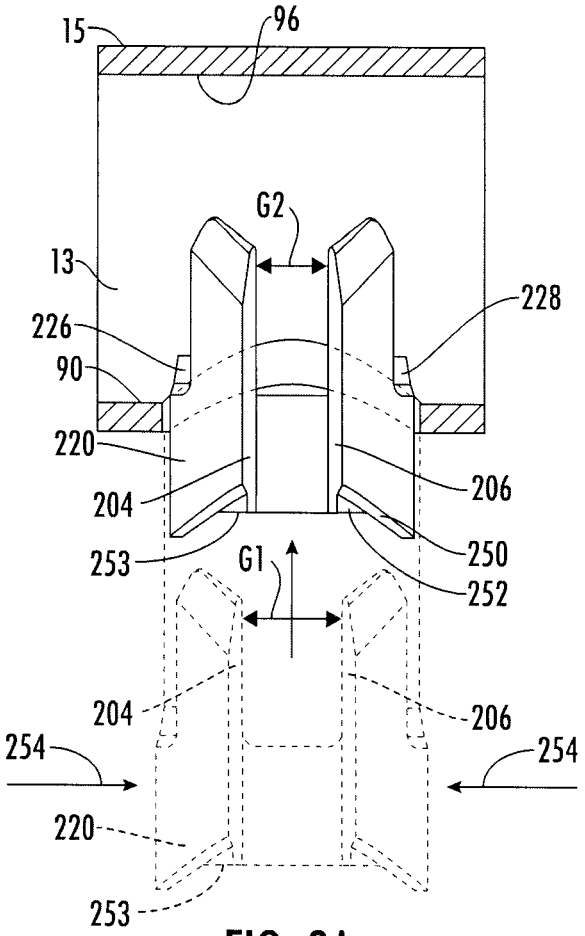
FIG. 9A is a side elevation view of the locking unit of the lighting module assembly shown in FIG. 8, shown partially installed into the tubular member, with a portion of the tubular member of FIG. 7 cut away to better show the locking unit, with the locking unit also shown in phantom prior to beginning of the installation.
Figure 9B:
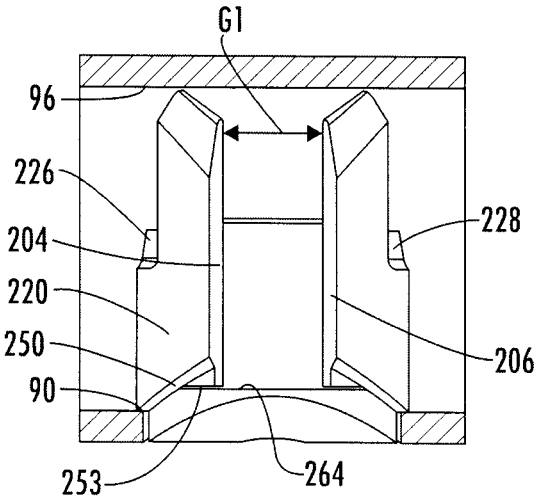
FIG. 9B is a side elevation view of the locking unit shown in FIG. 8 installed into the tubular member, with a portion of the tubular member of FIG. 7 cut away to better show the locking unit.
Figure 10:
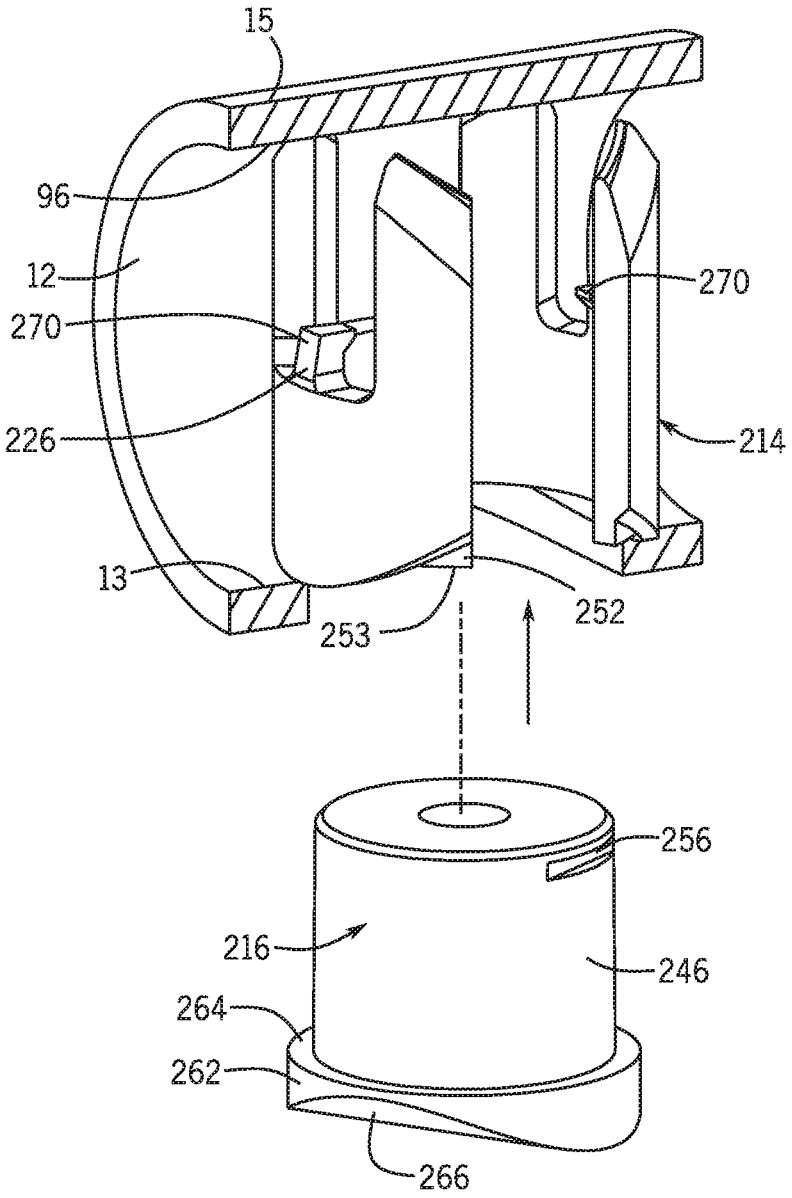
FIG. 10 is a perspective view of the lighting module assembly shown in FIG. 8, with the lighting module itself exploded from the locking unit, with a portion of the tubular member of FIG. 7 cut away to better show the locking unit.

As shown in FIGS. 9A and 9B, the locking unit 214 is configured to be compressed and inserted into the member 12 through the member aperture 11. The compression referred to in the previous sentence can be further described as squeezing the unit as shown by force arrows 254, or by flexing the inner and outer wall surfaces so that first vertical end wall 204 and a second vertical end wall 206 are closer together, thus narrowing the gap G1 (FIG. 9A) to a smaller gap G2 (FIG. 9A). Upon full insertion (arm ends 219 engaged with the top inner surface portion 96 of the member wall 21), the locking unit 214 is allowed to expand substantially back to the original position, so that gap G1 (FIG. 9B) is restored. Also upon full insertion, the bottom ledge 250 rests on the member inner wall surface 13 of the member 12, and the bottom side wall 252 is positioned against the member aperture 11. In this manner, the locking unit 214 is effectively secured inside the member 12, as shown in FIGS. 9B and 10. It is intended that removal of the locking unit 214 from the member 12 be substantially impossible without a specialized tool.

Figure 8:
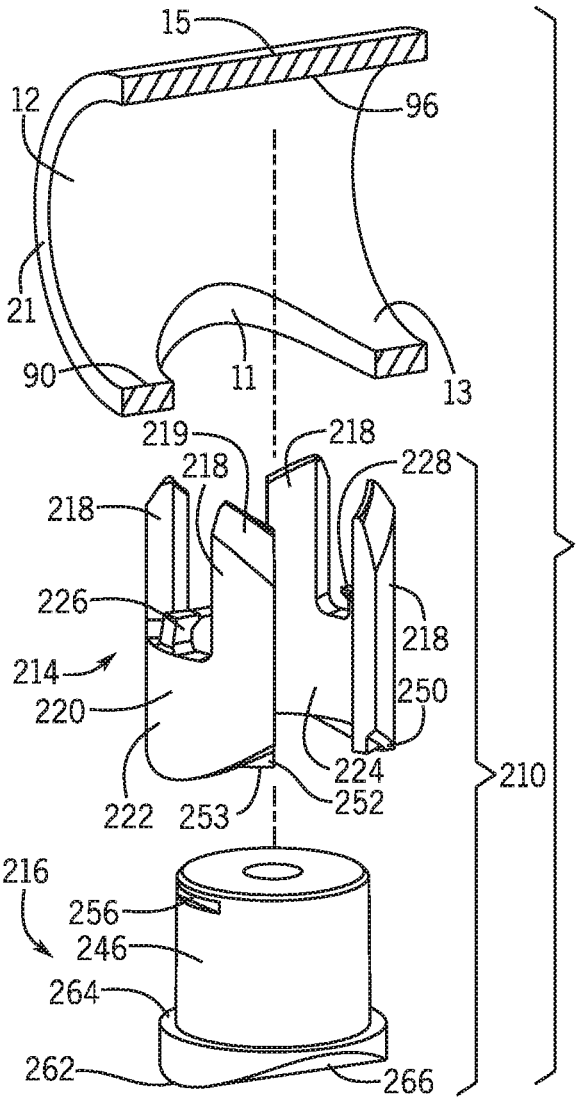
FIG. 8 is an exploded view of the lighting module assembly and tubular member shown in FIG. 7, with a portion of the tubular member of FIG. 7 cut away to better show the lighting module assembly.

Similar to the lighting module 16 of the first embodiment, the lighting module 216 can include the same internal electrical components configured to deliver power to a light source 280. As such, they will not be repeated again here. As shown in FIGS. 8 and 10, the lighting module 216 includes a generally cylindrical outer wall 246 that includes a plurality of module slots 256 sized and shaped to rotatably engage the plurality of latch tabs 270. In FIG. 8, the one module slot 256 is shown, while the module slot 256 on the opposite side is shown in FIG. 10. The outer wall 246 terminates at its bottom in a ring 262 having a larger outer dimension than the outer wall. The ring 262 has a top ring ledge surface 264 where the ring intersects the outer wall, and an outer face 266 on the surface opposite the top ring ledge surface, the outer face substantially matching the shape of the outer surface of the hollow member 12.

Figure 11:
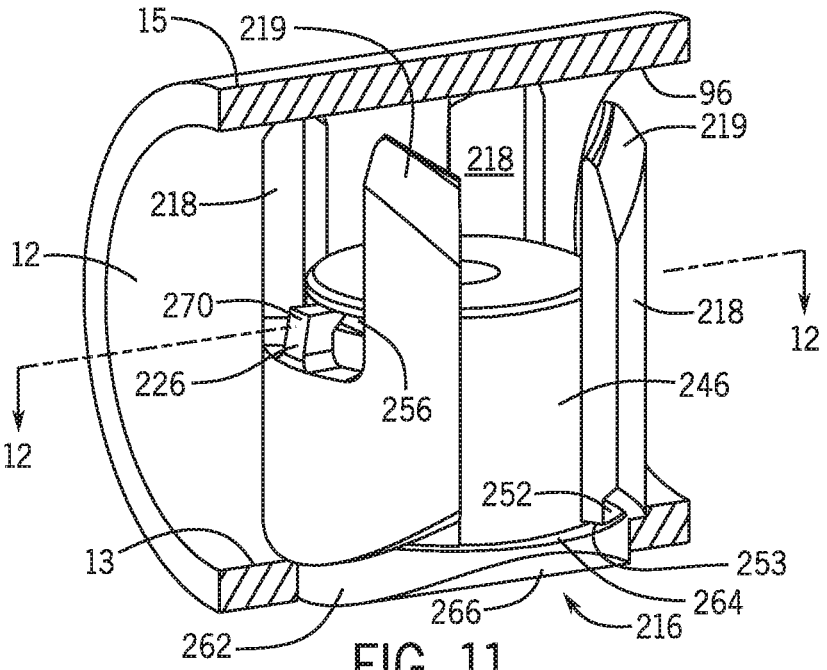
FIG. 11 is a perspective view of the lighting module assembly shown in FIG. 8, with the tubular member partially cut away, and showing the lighting module having been slid into a locked position.
Figure 12:
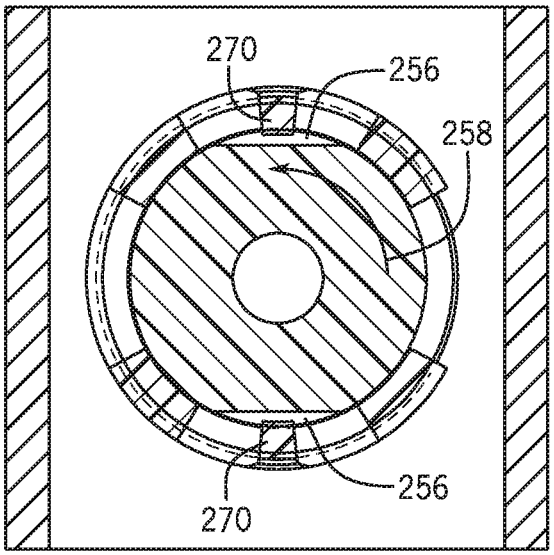
FIG. 12 is a cross sectional view of the lighting module assembly shown in FIG. 11, taken along line 12-12, and showing the lighting module in the locked position.

In use, the lighting module 216 is inserted with a rotational position relative to the locking unit 214 that the module slots 256 line up with the latches 226, 228 and included tabs 270, the position as shown in FIGS. 11 and 12. The latches 226, 228 may be sufficiently flexible that they simply flex outward to permit the sliding insertion of the lighting module 216 up into the locking unit 214. Alternatively, the support base 220 itself may be flexible enough on a gross level to accommodate the extra room temporarily needed. Once inserted far enough that the top ring ledge surface 264 of the lighting module 216 contacts bottom side wall 252 of the locking unit 214, and thus, when module slots 256 are at about the same depth as the tabs 270, the tabs will snap into and thus engage the slots. Thus the fact that top ring ledge surface 264 of the lighting module 216 contacts bottom wall 253 of the locking unit 214 acts as a positive contact/stop surface, preventing the lighting module from moving any further into the locking unit or the hollow member 12.

Figure 13:
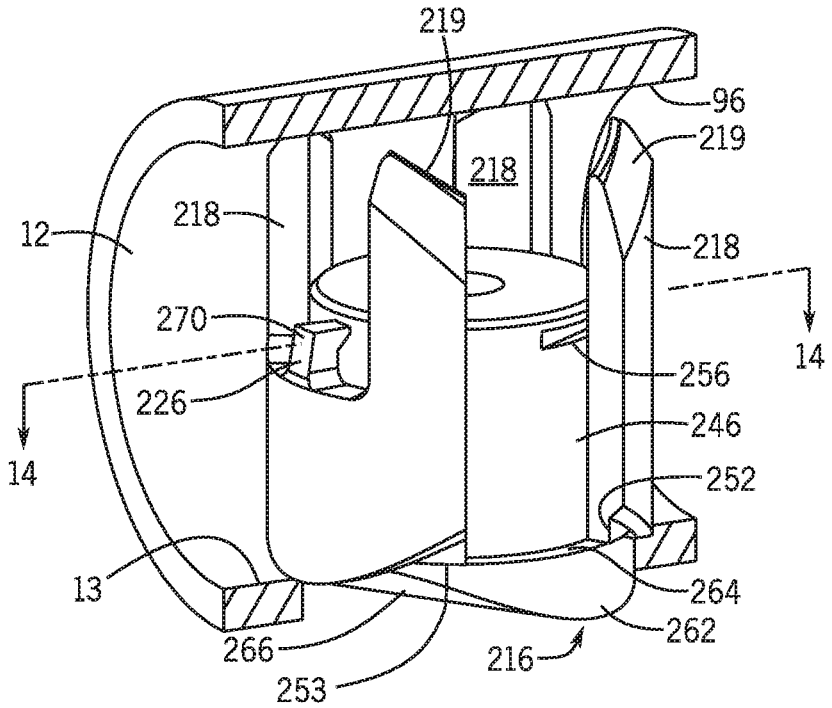
FIG. 13 is a perspective view of the lighting module assembly shown in FIG. 8 installed in the tubular member, with the tubular member partially cut away, and showing the lighting module having been rotated into an unlocked position.
Figure 14:
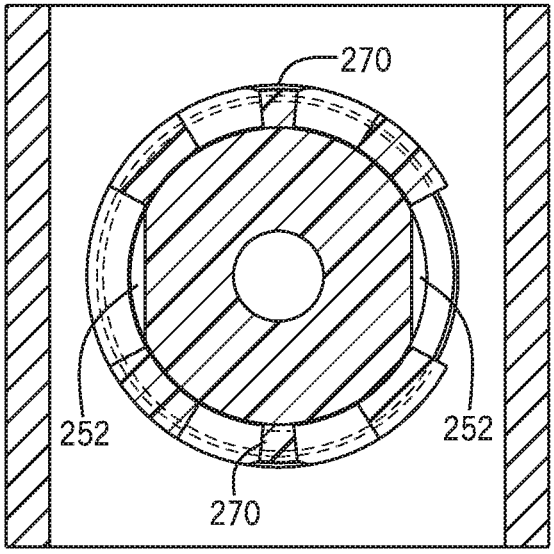
FIG. 14 is a cross sectional view of the lighting module assembly shown in FIG. 13, taken along line 14-14, and showing the lighting module having been rotated into the unlocked position, ready to be slid out of the locking unit.

Torque apertures 282 (FIG. 7) may be provided in the outer face 266 of the lighting module 216 to enable the rotation of the module. When it is desired to remove the lighting module 216 from the locking unit 214, the torque apertures 282 may be used to rotate the lighting module so that the module slots 256 are no longer engaged by the tabs 270, as shown in FIGS. 13 and 14, and the lighting module may be slid out of the locking unit.

Figure 15:
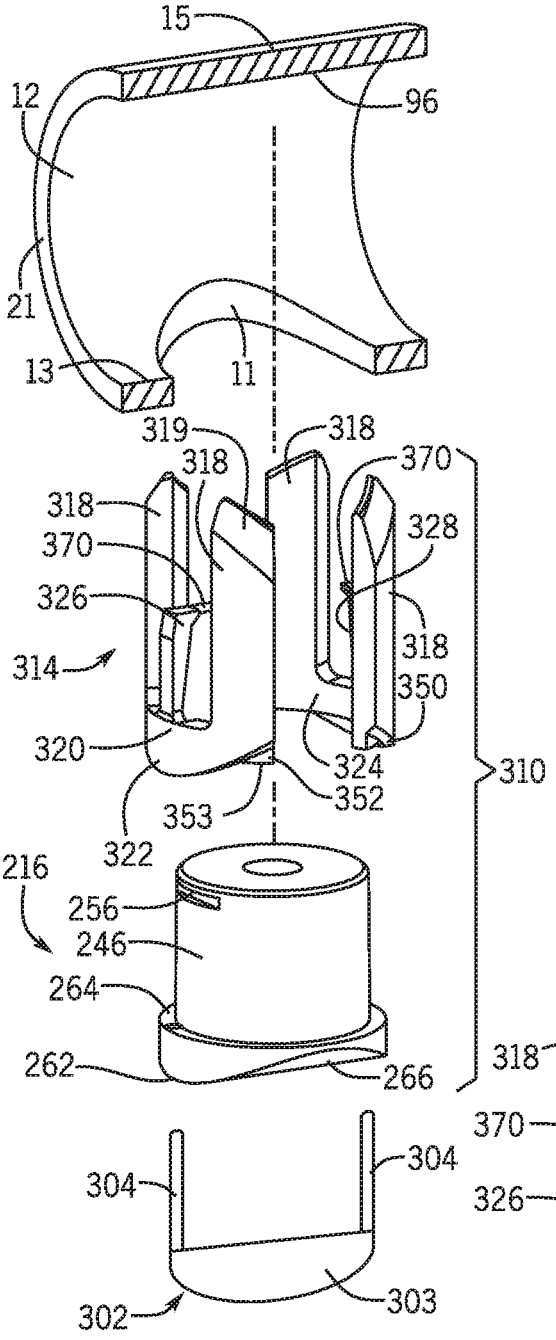
FIG. 15 is an exploded view of an exemplary lighting module assembly installed in an exemplary tubular member, constructed according to another alternative embodiment of the invention.
Figure 16:
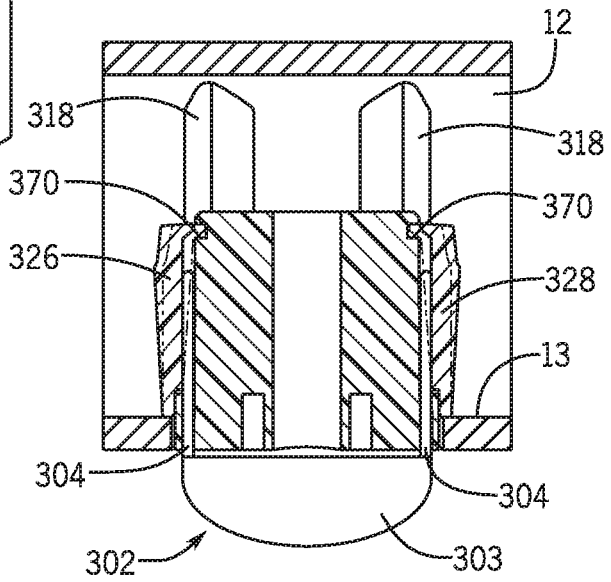
FIG. 16 is a cross sectional view of the lighting module assembly and tubular member shown in FIG. 15.

Shown in FIGS. 15 and 16 is a lighting module assembly 310 constructed according to another alternative embodiment of the invention. As shown in these figures, the assembly 310 includes a locking unit 314 and the same lighting module 216 as shown in FIGS. 8-13. The locking unit 314 includes a plurality of bracing arms 318 extending from a C-shaped support base 320, the locking unit 314 having an outer wall surface 322 opposite an inner wall surface 324. Opposite the support base 320, each bracing arm 318 includes an arm end 319 that is sized and shaped so as to, when installed inside member 12, generally contact the top inner surface portion 96 of the member wall 21. In addition to the bracing arms 218, a first latch 326 and a second latch 328 extend from opposing sides of the support base 320, each latch having a latch hook or latch tab 370 protruding inward. The latches 326 and 328 of this embodiment are longer than the latches 226 and 228 shown in FIGS. 8-13, or at least intended to be more flexible, whereas the latches 226 and 228 shown in FIGS. 8-13 are intended to be relatively rigid, not flexing appreciably. The support base 320 includes a bottom ledge 350 that extends inward from the outer wall surface 322 to join a bottom side wall 352 that extends further down and parallel to the outer wall surface 322. Side wall 352 terminates in a bottom wall 353. Contact between top ring ledge surface 264 of the lighting module 216 and bottom wall 353 of the locking unit 314 acts as a positive contact/stop, preventing the lighting module from moving any further into the locking unit or the hollow member 12.

In the embodiment shown in FIGS. 15-16, the latching and unlatching is different from that shown in FIGS. 8-13. Here, there is no need to rotate the lighting module 216. Rather, a tool 302, comprised of a handle 303 and prongs 304 projecting from the handle and substantially parallel to each other, may be used to insert those prongs 304 into the torque apertures 282 in the lighting module 216. The prongs 304 are of sufficient length so as to enable them to contact the latch hooks or tabs 370 and flex them away from engagement with the module slots 256 of the lighting module 216, thereby permitting the removal of the lighting module from the locking unit 314 and thus from the tubular member 12.

Figure 17:
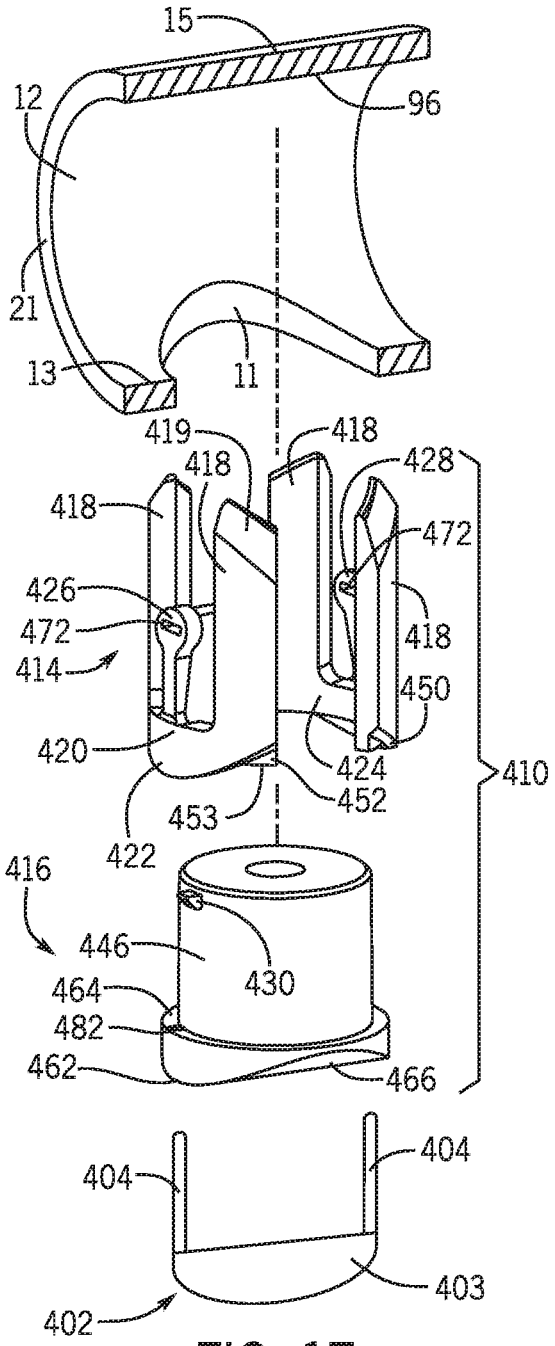
FIG. 17 is an exploded view of an exemplary lighting module assembly installed in an exemplary tubular member, which tubular member is shown in cross section, the lighting module assembly constructed according to still another alternative embodiment of the invention.

Shown in FIG. 17 is a lighting module assembly 410 constructed according to yet another alternative embodiment of the invention. As shown in these figures, the assembly 410 includes a locking unit 414 and a lighting module 416. The locking unit 414 includes a plurality of bracing arms 418 extending from a C-shaped support base 420, the locking unit 414 having an outer wall surface 422 opposite an inner wall surface 424. Opposite the support base 420, each bracing arm 418 includes an arm end 419 that is sized and shaped so as to, when installed inside member 12, generally contact the top inner surface portion 96 of the member wall 21. In addition to the bracing arms 418, a first latch 426 and a second latch 428 extend from opposing sides of the support base 420, each latch having a latch indentation or aperture or opening 472 formed therein. The latches 426 and 428 of this embodiment are longer than the latches 226 and 228 shown in FIGS. 8-13, or at least intended to be more flexible, whereas the latches 226 and 228 shown in FIGS. 8-13 are intended to be relatively rigid, not flexing appreciably. The support base 420 includes a bottom ledge 450 that extends inward from the outer wall surface 422 to join a bottom side wall 452 that extends further down and parallel to the outer wall surface 422. Bottom side wall 452 terminates in a bottom wall 453. In this embodiment, lighting module 416 includes a generally cylindrical outer wall 446, which is provided with latching tabs or hooks 430, sized and shaped to engage the plurality of latch openings 472. In FIG. 17, the one latching hook 430 is shown, while another latching hook 430 is formed on the opposite side. The outer wall 446 terminates at its bottom in a ring 462 having a larger outer dimension than the outer wall. The ring 462 has a top ring ledge surface 464 where the ring intersects the outer wall, and an outer face 466 on the surface opposite the top ring ledge surface. Top ring ledge surface 464 of the lighting module 416 contacts bottom wall 453 of the locking unit 414 so as to act as a positive contact/stop surface, preventing the lighting module from moving any further into the locking unit or the hollow member 12.

In the embodiment shown in FIG. 17, the latching and unlatching is again different from that shown in FIGS. 8-13, and similar to that shown in FIGS. 15-16. Here again, there is no need to rotate the lighting module 416. Rather, a tool 402, comprised of a handle 403 and prongs 404 projecting from the handle and substantially parallel to each other, may be used to insert those prongs 404 into the apertures 482 formed for that purpose in the ring 462 of lighting module 416. The prongs 404 are of sufficient length so as to enable them to contact the latches 426 and flex them away from engagement with the latching hooks 430 of the lighting module 416, thereby permitting the removal of the lighting module from the locking unit 414 and thus from the tubular member 12.

Non-rotating removals, such as those described with reference to FIGS. 15-16 and FIG. 17, are particularly useful if the cross section of the lighting module 416 is not round, that is, some other shape, such as oval or square or rectangular, as the lighting module will not so easily lend itself to rotation relative to the respective locking unit.

Figure 18:
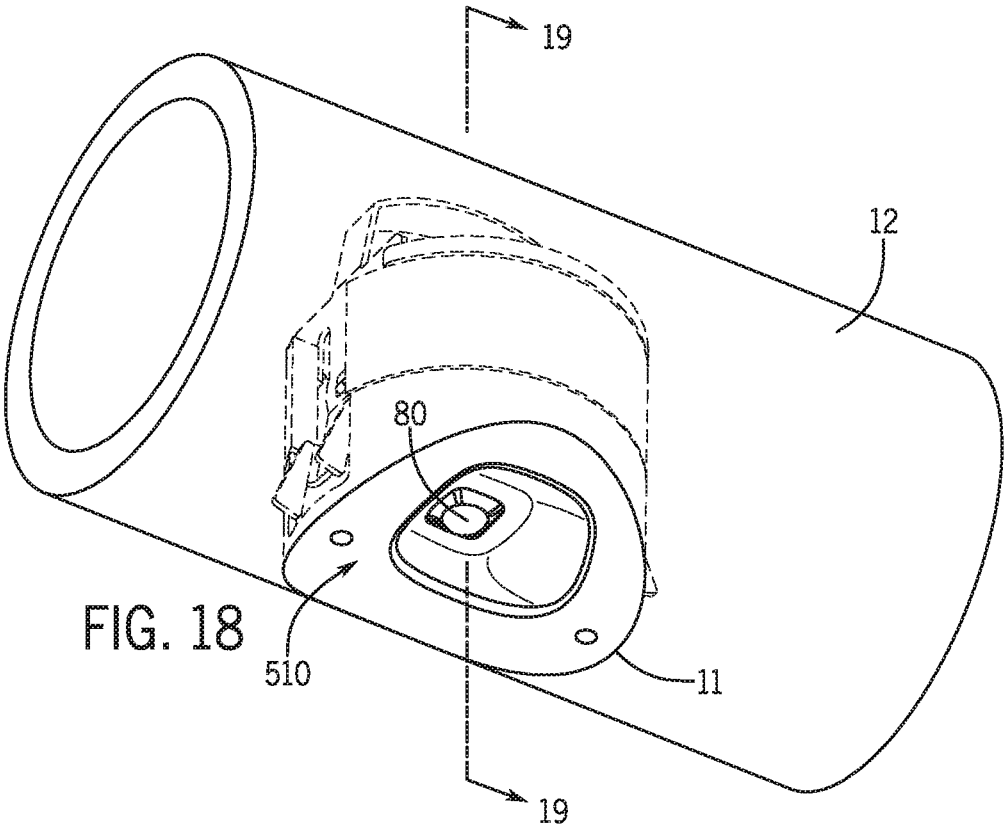
FIG. 18 is a bottom perspective view of an exemplary lighting module assembly installed in an exemplary tubular member, constructed according to another alternative embodiment of the invention.
Figure 19:
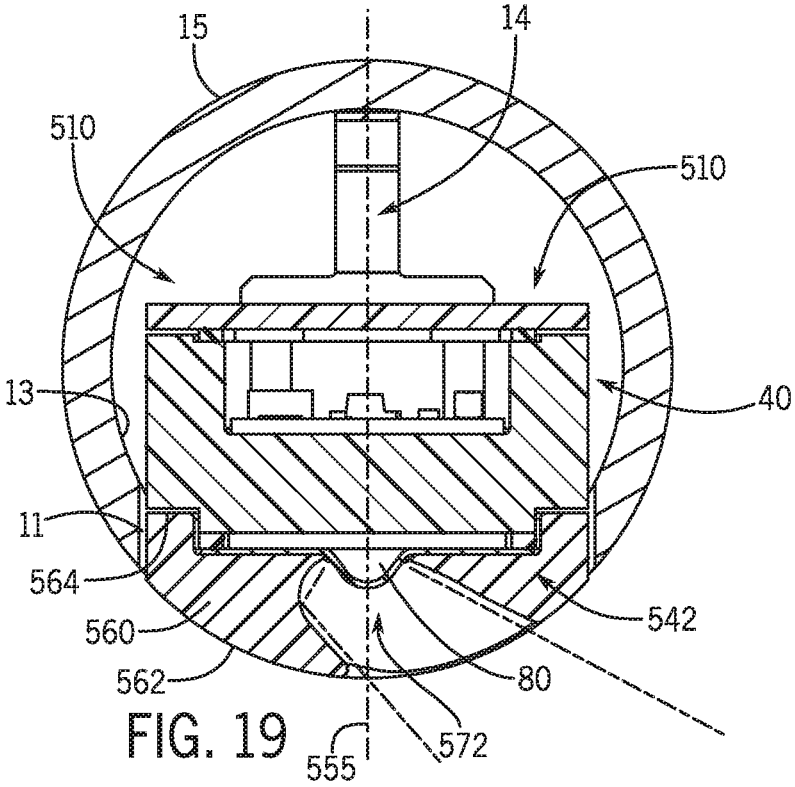
FIG. 19 is a cross sectional view of the exemplary lighting module assembly and tubular member shown in FIG. 18, taken along line 19-19.

FIGS. 18 and 19 illustrate a lighting module assembly 510 constructed according to yet another alternative embodiment of the invention. As shown in these figures, the assembly 510 is similar to that shown in FIGS. 1-6C in that the locking unit 14 and module base 40 can be the same or substantially the same, while the module cover 42 (hereafter referred to as 542) is modified to emit light from the LED light source at an angle, rather than straight down. This serves to accommodate the desire for light emanating from a railing to reach a walking area to the side of the railing, rather than the area directly beneath the railing, where most people do not walk. The module cover 542 includes a cover wall 560 having a cover wall bottom 562 and a cover wall top 564. The light source 80 from the module base 40 is positioned to pass light into a reflector portion 572 of the module cover 542. In contrast to the conical reflector portion 72 of the module assembly 10, the reflector portion 572 directs emitted light generally away from a central vertical axis 555 of the module assembly 510. In at least some embodiments, the reflector portions 72 and 572 can include various sizes and shapes to direct emitted light in numerous configurations (e.g. 360 degree symmetric, 180 degree symmetric, asymmetric, etc.), without the requirement that the light source be reoriented. In addition, the lens 85 can serve as a refracting and/or reflecting optic to direct the emitted light in numerous configurations. Due to the modularity of the module assemblies 10, 510, etc., the module cover 542 can be selected from a group of module covers having different lens/reflector configurations and selectively secured to module bases 40 as desired to provide a variety of fixture options with a reduced manufacturing cost, and again, without reorienting the light source.

Figure 20:
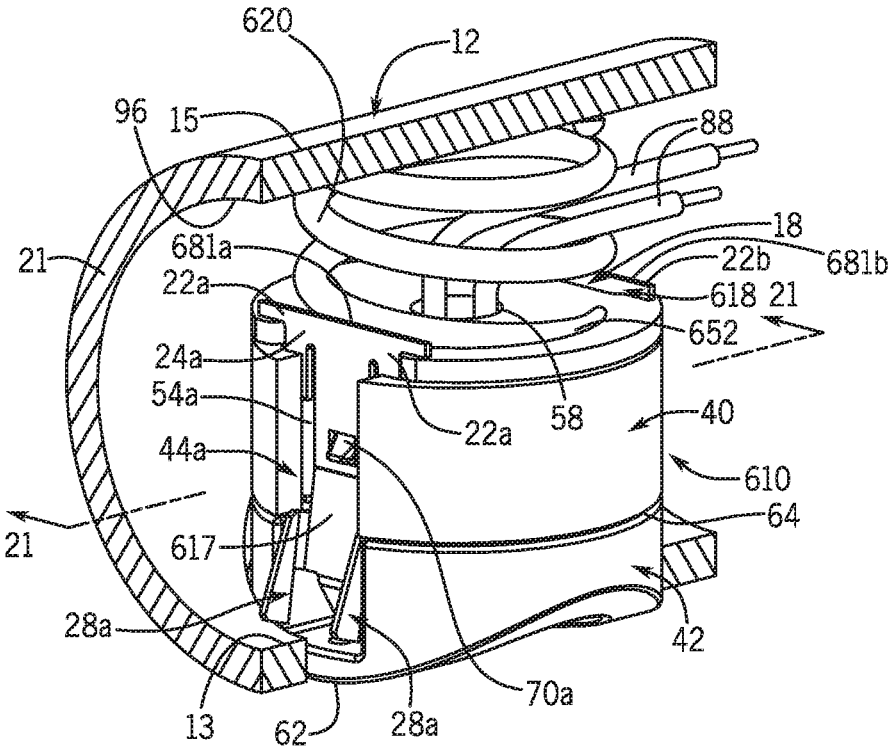
FIG. 20 is a perspective view of a lighting module assembly constructed according to another alternative embodiment of the invention, with a portion of the tubular member cut away to better show the lighting module assembly.
Figure 21:
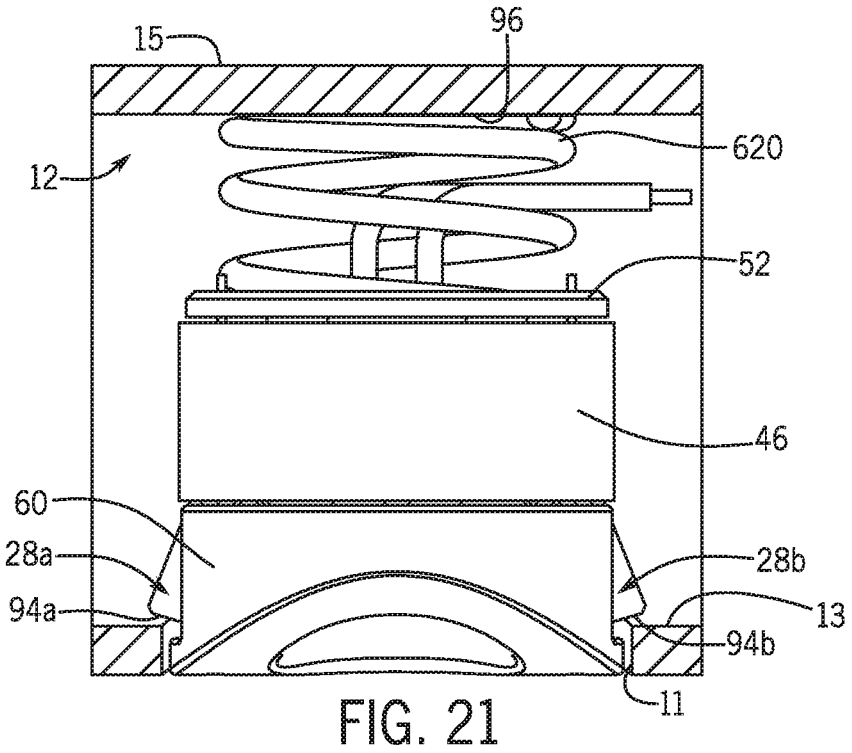
FIG. 21 is a side elevation view of the lighting module assembly shown in FIG. 20, with a portion of the tubular member cut away to better show the lighting module assembly.

FIGS. 20 and 21 illustrate a lighting module assembly 610 constructed according to yet another alternative embodiment of the invention. The assembly 610 omits the spanner 20 that interconnects the first locking body 17 and second locking body 18 as seen in FIGS. 1-6C. As such, the first locking body 617 and second locking body 618 retain the aforementioned design and function relative to the module base 40 and module cover 42, but without an interconnection therebetween. As shown in FIG. 20, the first locking body 617 and second locking body 618 still serve to interlock the module base 40 and module cover 42, although their shoulders extend straight across shoulder tops 681*a* and 681*b* without abutting a spanner. In place of the spanner 20, a resilient member, such as a coil spring 620, is engaged with the cap 652. Thus in at least some embodiments, the cap 652 is modified to secure or otherwise receive the coil spring 620. Similar to the spanner 20 discussed above, the coil spring 620 can be sized and shaped to engage the top inner surface portion 96 of the member wall 21. In this manner, a downward bias (spring force) is provided by the coil spring 620 to prevent the assembly 610 from moving any further into the member 12, as well as to provide a force to eject the assembly 10 during removal.

Figure 22:
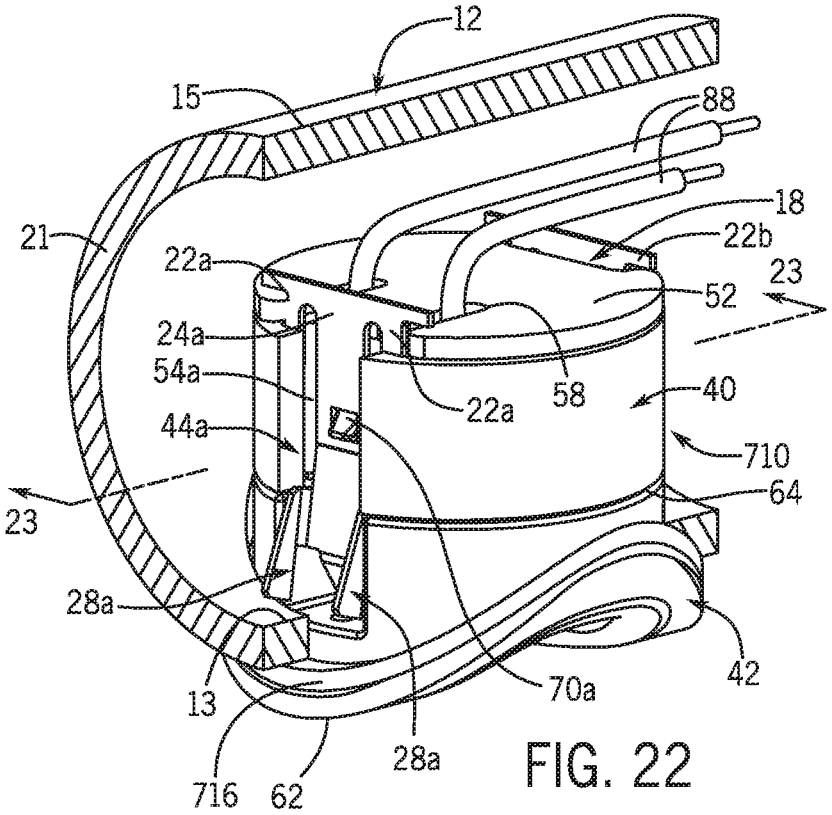
FIG. 22 is a perspective view of a lighting module assembly constructed according to another alternative embodiment of the invention, with a portion of the tubular member cut away to better show the lighting module assembly.
Figure 23:
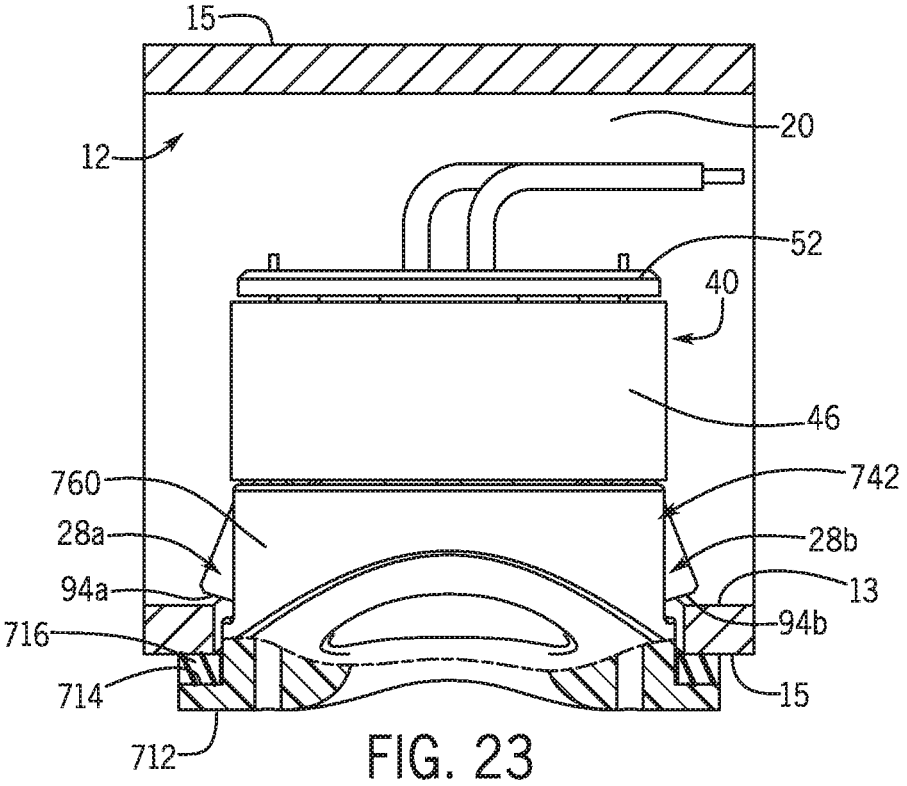
FIG. 23 is a side elevation view of the lighting module assembly shown in FIG. 20, with a portion of the tubular member and the modular cover cut away.

FIGS. 22 and 23 illustrate a lighting module assembly 710 constructed according to yet another alternative embodiment of the invention. As shown in these figures, the assembly 710 is similar to the module assembly 610 described with reference to FIGS. 20 and 21, in that the module assembly 710 shown in FIGS. 22 and 23 utilizes the same locking body configurations, which lack an interconnecting spanner 20, and as such, serve to interlock the module base 40 and module cover 42 as discussed above.

In the embodiment shown here, the module cover 742 of the assembly 710 includes a cover flange 712 that extends outwards around the bottom of the cover wall 760. The cover flange 712 includes a flange top surface 714 and is, in whole or in part, sized to be larger than the member aperture 11, such that it overlaps at least a portion thereof, thereby preventing the module assembly 710 from being completely insertable into the member 12. A flange gasket 716 can be provided so as to seal the interconnection between the cover flange 712 and the member 12, and also to act as a spring to take up any loose tolerance in the parts, and thus improve the fit of the parts together as well. The module assembly 710 is secured to the member 12 by inserting the module assembly 710 into the member aperture 11 until the latch bottom portions 94*a* and 94*b* of the first locking body 717 and second locking body 718 pass the member inner wall surface 13 and have sprung outwards, and the flange gasket 716 is engaged with the member outer surface 15.

The aforementioned components of the lighting module assembly according to the present invention can be comprised of various types of materials, including but limited to metal, plastics, etc. Fasteners for securing components can include but are not limited to screws, rivets, adhesives, etc. In addition, numerous components of the apparatus can be comprised of various shapes, including tubular, curved, planar, angled, square, circular, rectangular, etc. It is specifically intended that the aforementioned apparatus not be limited to the embodiments and illustrations expressed herein, but include modified forms of those embodiments including portions of the embodiments and combinations of elements of different embodiments as come within the scope of the following claims. Further, the use of the term "plurality" shall be understood to include one or more of a specified component.

What is claimed is:

1. A module assembly for mounting in an aperture of a hollow member, the aperture having a shape, the assembly comprising:

a lighting module having an outer shape that substantially matches the shape of the aperture;

a light source and lighting controls mounted within the lighting module; and at least one locking body for connecting to the lighting module and locking the lighting module in the hollow member, the locking body having at least one latch member, mounted on one side of the locking body, and having a latch bottom portion extending from the bottom of the locking body, and also away from the lighting module.

2. A module assembly for mounting in an aperture of a hollow member having an inner wall, the aperture having a shape, the assembly comprising:

a lighting module having an outer shape that substantially matches the shape of the aperture;

a light source and lighting controls mounted within the lighting module; and at least one locking body for connecting to the lighting module, the locking body having at least one latch member for engaging the inner wall of the hollow member to secure the lighting module within the hollow member.

3. The module assembly of claim 2, wherein the at least one locking body comprises at least two locking bodies, each having at least one latch member for engaging the inner wall of the hollow member.

4. A module assembly for mounting in an aperture of a hollow member, the hollow member having an interior surface and an exterior surface, and the aperture having a shape and the exterior surface having a shape, the assembly comprising:

a lighting module having an outer shape that substantially matches the shape of the aperture and an outer surface that substantially matches the shape of the exterior surface of the hollow member;

a light source and lighting controls mounted within the lighting module; and at least one locking body for connecting to the lighting module and locking the lighting module in the hollow member, the locking body having at least one latch member, mounted on one side of the locking body, and having a latch bottom portion extending from the bottom of the locking body, and also away from the lighting module.

5. A module assembly for mounting in an aperture of a hollow member, the hollow member having an interior surface and an exterior surface, and the aperture having a shape and the exterior surface having a shape, the assembly comprising:

a lighting module having an outer shape that substantially matches the shape of the aperture and a bottom that substantially matches the shape of the exterior surface;

a light source and lighting controls mounted within the lighting module; and at least one locking body for connecting to the lighting module, the locking body having at least one latch member, mounted on one side of the locking body, wherein the at least one latch member engages the interior surface of the hollow member to secure the lighting module in the hollow member with the bottom of the lighting module situated flush with the exterior surface of the hollow member.

6. A module assembly for mounting in an aperture of a hollow member, the aperture having a shape, the assembly comprising:

a lighting module having a flange preventing the lighting module from entering the aperture exceeding a predetermined extent;

a light source and lighting controls mounted within the lighting module; and at least one locking body for connecting to the lighting module and locking the lighting module in the hollow member, the locking body having at least one latch member, mounted on one side of the locking body, and having a latch bottom portion extending from the bottom of the locking body, and also away from the lighting module.

7. A module assembly for mounting in an aperture of a hollow member, the hollow member having an interior surface and an outer surface, and the aperture having a shape and the outer surface having a shape, the assembly comprising:

a lighting module having an outer shape that substantially matches the shape of the aperture and an outer surface that substantially matches the shape of the outer surface of the hollow member, the lighting module further having a plurality of lighting module apertures and a top ring ledge surface;

a light source and lighting controls mounted within the lighting module; and a locking unit formed of a resilient material, having a top support to abut against the interior surface of the hollow member and including a first vertical end wall and a second vertical end wall spaced apart from the first vertical end wall by a gap, the resilience of the material of the locking unit allowing the gap to be reducible, the locking unit further including a bottom wall abutting against the top ring ledge surface when assembled with the lighting module.

8. A lighting module assembly for mounting in a hollow member, the assembly comprising:

a module base having an outer shape and at least two channels formed in sides thereof;

a module cover having an outer shape that, at least in one dimension, substantially matches the outer shape of the module base, and having latches sized and spaced so as to substantially mate with the channels of the module base, each latch having a latch tab at a distal end of the latch;

at least one locking body for connecting the module cover and the module base together, the locking body including:

a body aperture formed through the locking body and capable of engaging with a respective latch tab; and at least one latch member; and a light source positioned inside the module cover for directing light therefrom.

9. A lighting module assembly for mounting in a hollow member, the assembly comprising:

a module base having an outer shape and at least two channels formed in sides thereof;

a module cover having an outer shape that, at least in one dimension, matches or substantially matches the outer shape of the module base, and having latches sized and spaced so as to substantially mate with the channels, each latch having a latch tab at a distal end of the latch;

a locking unit for connecting the module cover and the module base together, the locking unit formed of a resiliently flexible material and having two locking bodies connected together by a spanner, each locking body including:

a locking body aperture capable of engaging with a respective latch tab; and a pair of latch members; and a light source positioned inside the module cover for directing light therefrom.

10. A lighting module assembly for mounting in a hollow member, the assembly comprising:

a module base having an outer shape and at least two channels formed in sides thereof;

a module cover having a light source, and having an outer shape that, at least in one dimension, substantially matches the outer shape of the module base, and having latches sized and spaced so as to substantially mate with the channels of the module base, each latch having a latch tab at a distal end of the latch; and a locking unit for connecting the module cover and the module base together, the locking unit formed of a springy material and having two locking bodies opposing each other and connected together by a spanner, each locking body including:

a ramped tang extending from the bottom of the locking body away from the spanner, and also toward the opposite locking body, and a pair of latch members, one mounted on each side of the ramped tang, and each having a wall with a latch bottom portion extending from the bottom of the locking body away from the spanner.

* * * * *